US005280916A

United States Patent [19]

Gleason, Jr.

[11] Patent Number: 5,280,916

[45] Date of Patent: Jan. 25, 1994

[54] DOUBLE DENOMINATION CARDS

[76] Inventor: Richard F. Gleason, Jr., 77 Stadium Way, Allston, Mass. 02134

[21] Appl. No.: 770,580

[22] Filed: Oct. 3, 1991

[51] Int. Cl.[5] ..... A63F 1/00

[52] U.S. Cl. ..... 273/304; 273/307

[58] Field of Search ..... 273/304, 303, 305, 307, 273/293, 292, 308

[56] References Cited

U.S. PATENT DOCUMENTS

D. 212,239 9/1968 Schick ..... 273/304
712,566 11/1902 Moller ..... 273/304
4,170,358 10/1979 Hancock ..... 273/304

FOREIGN PATENT DOCUMENTS 23073 of 1909 United Kingdom ..... 273/304
24658 of 1910 United Kingdom ..... 273/304

*Primary Examiner*—Benjamin H. Layno

[57] ABSTRACT

A deck of 52 playing cards each of which displays two randomly paired denominations at least one of which is no lower than 8 and of contrasting suits (4) (6). A player selects either denomination for use in composing a hand of cards for any game. One of each card's two denominations (4) always bears a code means (8) that designates particular denominations only and all others marked with the same code as the only 52 denominations that form a complete deck of single denomination cards of the prior art. Single denomination games may be played with a double denomination deck when only the coded denominations are employed.

1 Claim, 1 Drawing Sheet

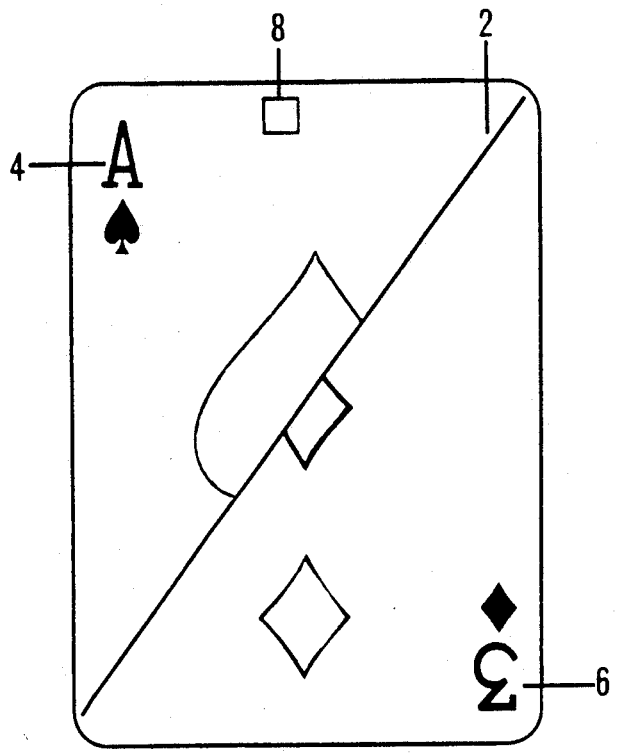
8
2
4
A
6

DOUBLE DENOMINATION CARDS

BACKGROUND—FIELD OF INVENTION

This invention relates generally to playing cards, specifically to doubling the denominations available on each playing card.

BACKGROUND—DESCRIPTION OF PRIOR ART

Heretofore, the use of a 52-card deck of single denomination poker cards to play a wide variety of card games is well known in the art. Names, denominations, ranking and all four suits are also well known. A common objection to playing any game with cards of the prior art is the shortage of high value cards. Too few high value cards must be shared with all the other players in a game. Hands that offer the promise of winning are scarce. A hand that wins is often the least poor hand in the game. Each card of the prior art must be used as its one denomination dictates. Wild cards can be invoked to improve the ratio of high value cards. As is well known in the art, the use of wild cards is considered to be childish and frivolous.

Doubling the denominations available for use in a game from 52 to 104 would produce the needed inventory of high value denominations. But a deck of 104 cards is not practical under most game conditions.

OBJECTS AND ADVANTAGES

Accordingly, it is a primary object and advantage of my invention to provide two denominations on each card and thereby double the options for the use of each card in the deck compared to the single denomination cards of the prior art.

It is another object of my invention to provide two or more uses for each card without changing in any way the number of cards to be dealt in any game of the prior art, nor to increase nor decrease the count of the 52 card deck from the prior art.

It is another object of the present invention to allow players unlimited choice as to which of each two deniminations per card a player may use until a final selection must be made at the last moment of play.

It is another object of the present invention to randomly pair denominations so that each card bears at least one denomination that is no lower than an eight and that no card bears two denominations of the same suit. This increases the hierarchy of tens, jacks, queens, kings and aces in inventory from 20 of the prior art to 40 of the present invention.

It is another object and advantage of the present invention to enable the dealer using a deck of double denomination cards to play a game using single denomination cards without the need to change decks.

DESCRIPTION OF THE DRAWING

An example of the invention is further described with reference to the accompanying drawing which shows the preferred embodiment of a double denomination playing card with the face area divided into two equal parts by a border 2. Separate and randomly paired denominations are shown at 4 and 6. The denomination being played is usually held pointing upwards in the correct reading posture. A code or symbol 8 appears on one denomination area on each card. When only those denominations that display said code or symbol are used in play and the denominations that do not display a code are ignored, the denominations bearing said code form a deck of 52 denominations which are single option cards of the prior art.

DESCRIPTION OF INVENTION

The drawing depicts the preferred embodiment of the invention, although it is readily understood that the display area of each card may be divided horizontally in the middle rather than diagonally. Referring to the drawing and the reference numerals 4 and 6, these denominations are different from each other as are all denomination pairings throughout the deck. Of the two aces of spades contained in each double denomination deck, one ace of spades might be paired with a 3 of diamonds as shown at 4 and 6 while the other ace of spades might be paired with a 5 of clubs. Said arrangement might be entirely different in another deck of double denomination cards. Denominations of the same rank should not be paired together because an object of the invention is to broadly spread high value cards that bolster those with lower denominations. Suits are mixed.

As seen at reference numeral 8 of the drawing, when all denominations that display a code or symbol are used and denominations that have no code are ignored, the coded denominations combine into a complete deck of 52 single option cards of the prior art.

In another embodiment of the present invention, by supplying four extra cards with each deck of double denomination cards with said cards being the 8 of diamonds paired with the 9 of clubs; the 8 of clubs paired with the ten of hearts; the jack of spades paired with the 9 of hearts; the queen of diamonds paired with the 8 of hearts, the deck so amended can be used as a 56 card pinocle deck. By printing the pinocle legend on said cards indicia they can be easily removed from the deck when pinocle play is concluded.

OPERATION OF THE INVENTION

In the preferred embodiment of the invention the border at reference numeral 2 divides the two denominations at 4 and 6 by running in an upwards, left to right diagonal direction. This division design makes it possible to view the entire design of a denomination when several cards are held in the hand in a fan-like mode during play. Another embodiment of the present invention is to divide the denomination area into two parts horizontally. Other embodiments of the invention might display more than two denominations and in a variety of viewing arrangements.

The pairing of denominations on cards is designed so as to spread the ranks of the higher valued denominations broadly through the deck to make every card important. The pairings are random to restrain players from memorizing the 52 pairings. Unpredictability also stimulates creativity. Double denomination cards make the rarest of card combinations from the prior art regular occurances.

Another embodiment of the invention is to supply four additional cards with each deck. These extras bear the legend pinocle on their faces so they may be easily removed from the deck after use. As is well known, the game of pinocle is played with all cards above the rank of eight from two decks of cards of the prior art. Each double denomination card is also a pinocle card. The four extra cards aforementioned provide the eights and nines that are paired with higher denominations which, when employed, would unfairly remove said eights and nines from circulation in pinocle.

The code or symbol at reference numeral 8 enables players using double denomination card to revert to single denomination games without the need to change the deck of cards to those of the prior art. All denominations that display said code represent a complete deck of prior art cards providing denominations without said code are ignored in play. Said code helps to keep denominations from getting mixed up when only single denomination usage is called for.

Another embodiment of the code is to use color or a patten of lines in the background of the coded denomination to make the distinction more obvious.

CONCLUSION, RAMIFICATION AND SCOPE OF INVENTION

Thus the reader will see that double denomination cards of the present invention provide a certain and convenient means of improving the value of card combinations of any game by doubling the choice of denominations on each card of the deck. No rules of play of any game need to be changed for double denomination card usage. A player has the option to use either of the two denominations displayed on each card. Choices may be changed any number of times in the course of play.

The merging of two decks of cards into one causes a hand of gin rummy played with double denomination cards to be concluded in as few as two to three cards drawn after the deal. Opening a hand of draw poker with at least two pair is common. High value combinations in seven-card stud are so frequent that five-card straights and flushes often lose. A game of cribbage is played in less than half the time it used to take with cards of the prior art.

Double denomination cards are two decks in one when the code means is employed in that single denomination play can be conducted with the double denomination deck when only coded denominations are used.

With the introduction of four specific double denomination cards to the regular double denomination deck, the expanded 56-card deck can be used to play pinocle. Heretofore, two decks of prior art cards were required for pinocle; or, one deck of pinocle cards could be purchased with which other card games cannot be played. The economy and convenience of double denomination cards was not available in the prior art.

I claim:

1. A pack of fifty-two playing cards, each card having a front playing face and a back face, said back face of each playing card having identical indicia, said front playing face of each playing card divided into two playing fields wherein said pack of playing cards comprises fifty-two first playing fields and fifty-two second playing fields;

means visually distinguishing said first playing fields from said second playing fields;

said fifty-two first playing fields representing a first set of fifty-two denominations, said first set of non-denominations divided into four suits of Spades, Hearts, Diamonds and Clubs, each suit having thirteen value designations, listed from lowest value to highest value, of 2, 3, 4, 5, 6, 7, 8, 9, 10, Jack, Queen, King and Ace, wherein each first playing field represent a non-denomination having one of said suits and one of said value designations, and each of said fifty-two first playing fields having a unique demonination;

said fifty-two second playing fields representing a second set of fifty-two denominations, said second set of denominations divided into four suits of Spades, Hearts, Diamonds and Clubs, each suit having thirteen value designations, listed from lowest value to highest value, of 2, 3, 4, 5, 6, 7, 8, 9, 10, Jack, Queen, King and Ace, wherein each second playing field represent a denomination having one of said suits and one of said value, designations, and each of said fifty-two second playing fields having a unique denomination;

said denominations being randomly distributed on said first and second playing fields wherein each of said playing cards having contrasting suits on each of its first and second playing fields, and all possible combination of suits being represented in said pack of playing cards wherein the combination of Spades/Hearts, Spades/Diamonds, Spades/Clubs, Hearts/Clubs, Heart/Diamonds and Diamonds/-Clubs are each represented on the first and second playing field of at least one playing card, each of said playing card having different value designations on each of its first and second playing fields, and each playing card having at least one value designation having a value of at least 8.

* * * * *